United States Patent [19]

Rast

[11] Patent Number: 4,633,916

[45] Date of Patent: Jan. 6, 1987

[54] ROLL-FORMED SHEAR-RESISTANT FRAME SLAT

[76] Inventor: John L. Rast, 29 Continental Apartments, Greenville, S.C. 29615

[21] Appl. No.: 747,779

[22] Filed: Jun. 24, 1985

[51] Int. Cl.[4] ..... D03D 9/00

[52] U.S. Cl. ..... 139/92

[58] Field of Search ..... 139/91, 92

[56] References Cited

U.S. PATENT DOCUMENTS

| | | | |
|---|---|---|---|
| 3,604,469 | 9/1971 | Schneiter et al. | 139/91 |
| 3,754,577 | 8/1973 | Heller | 139/92 |
| 4,484,604 | 11/1984 | Kramer et al. | 139/92 |

FOREIGN PATENT DOCUMENTS 2620778 10/1977 Fed. Rep. of Germany .

*Primary Examiner*—Henry S. Jaudon

*Attorney, Agent, or Firm*—Julian W. Dority

[57] ABSTRACT

A lightweight shear-resistant frame slat (A) is disclosed for use with a heddle frame assembly (10). The frame slat includes a thin wall, roll-formed steel back plate (B) and a thin wall, roll-formed steel front plate (C). A first ledge (38) is formed on the back plate (B) and a second ledge (54) is formed on the front plate (C). The ledges (38) and (54) are spaced apart to define a heddle rod mounting socket (62) which receives a stem (63) of a heddle rod (20) to mount the heddle rod with reduced shearing forces on the frame slat. A box shaped core space (58) is formed between the front and back plates in which a honeycombed structure (66) is disposed for increasing the stiffness of the frame slat. A reduced neck portion (50) is formed between the mounting socket (62) and the core space front and back sides are flush with each other and may be secured by any suitable means such as adhesive bonding.

19 Claims, 3 Drawing Figures

ROLL-FORMED SHEAR-RESISTANT FRAME SLAT

BACKGROUND OF THE INVENTION

The invention relates to a lightweight, reinforced shear-resistant heddle frame slat for use in a heddle frame assembly on a loom. Typically, heddle frame slats are utilized in the construction of a heddle frame on a loom to support the heddle rods on the loom. The heddle frame includes a top frame slat and a bottom frame slat which are spaced apart in the frame by a pair of side frame members. The individual heddles are slideably carried on the heddle rods and supported in the frame. The heddles include eyes through which the warp ends are threaded. The heddle frame raises and lowers the warp ends to create an open space called a shed through which the weft yarn is inserted during weaving. In lifting the warp ends during shedding, the heddle frame undergoes forces in a vertical direction while moving the warp ends which produces a bending motion on the frame slat and also produces shear forces between the heddle rod and the frame slat.

As the speeds at which the looms are driven increases, the inertial loading on the heddle frames during shedding is greatly increased. Since the inertial forces are dependent upon the mass of the heddle frame assembly, there has been a great need to provide light-weight frames structures for the heddle frame assembly without sacrificing structural integrity. During shedding, the heddle frame assembly reciprocates vertically in fast rapid strokes which increase as the operating speed of the loom increases. Therefore, the provision of lightweight components for the heddle frame assembly is a problem to which considerable attention need be given.

Typically a number of heddle frame assemblies are used in juxtaposed position. Two heddle frame assemblies move in opposing directions to create the shed. The thickness of the heddle frame assembly affects the amount of spacing between the two heddles. The amount of spacing between the two heddle frames determines the amount that the heddle frame assembly must move vertically in order to create a shed having a desired height. The device which inserts the weft pick through the shed requires that the shed be of a certain height and size for clearance. As the distance between the heddle frame assemblies increases, the greater distance the heddle frames need to reciprocate vertically in order to create the shed. Therefore if the overall thickness of the heddle frame assembly can be reduced, the frames can be closer together with less vertical movement required to create a desired shed. With decreased vertical movement comes a decrease in inertial forces and loading caused by the shedding motion.

U.S. Pat. No. 4,484,604 commonly owned by the assignee of the present application discloses a composite dual-faced heddle frame slat which is lightweight, therefore rendering it desirable for use on a heddle frame assembly for purposes of reducing inertial loading. However, the problem arises that a considerable amount of shearing forces exists at the point of attachment of the heddle rod and the frame slat. This is a critical area of the heddle frame assembly since the heddles which support the warp ends are attached to the heddle rod. Shearing forces are exerted at the area of attachment of the heddle rod and frame slat due to the forces produced by the heddles on the heddle rods.

Accordingly, an important object of the present invention is to provide a frame slat for use in the heddle frame assembly of a loom which is lightweight and decreased in thickness to reduce inertial forces.

Still another important object of the invention is the provide a frame slat for a heddle frame assembly having an integral heddle rod with reduced shearing forces at the area of attachment.

Still another important object of the invention is to provide a frame slat for a heddle frame assembly which includes a uniquely formed mounting socket along the length of the heddle frame slat for attachment of the heddle rod with minimized shearing forces.

Still another important object of the invention is to provide a frame slat for a heddle rod assembly which can be fabricated from thin wall, roll-formed steel so that the frame slat is reduced in its overall thickness whereby the heddle frame assemblies can be placed closer together requiring less vertical movement during shedding.

Still another important object of the present invention is to provide a frame slat for a heddle frame assembly which may be fabricated from two thin roll-formed steel plates so that accessory and attachment blocks may be fabricated with the frame slat as well as the other reinforcing features in a simplified structure.

SUMMARY OF THE INVENTION

The above objectives are accomplished according to the present invention by providing a frame slat which is fabricated from a pair of thin, roll-formed steel plates wherein the plates fit and bond together to form a box shaped core space adjacent one edge of the frame slat and a pair of spaced ledges at the opposing edge of the frame slat. The spaced ledges define a heddle rod mounting socket along the entire length of the frame slat. By providing a generally T-shaped heddle rod of a carbon fiber pultrusion, an attachment stem is provided on the heddle rod which fits into the mounting socket. Shearing forces between the attachment of the heddle rod and the frame slat are effectively minimized by the mounting socket attachment. A honeycombed reinforced structure may be included in the box shaped core space for adding stiffness and bending resistance to the frame slat. A stiffening strip may be added to the outer edge of the box shaped hollow space to further add increased stiffness to the frame slat assembly. By this means, a frame slat is provided having a decreased overall thickness and an increased resistance to shearing forces in the critical area of the heddle rod and frame slat connection.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
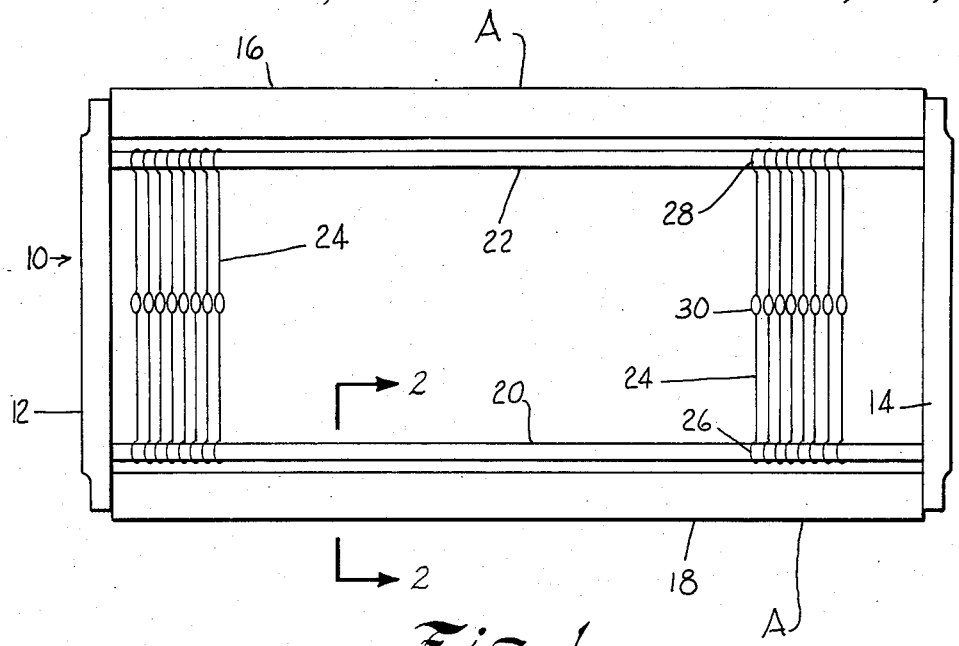
FIG. 1 is an elevation illustrating a heddle frame assembly for a loom having a frame slat constructed according to the instant invention.

The invention relates to a vertically reciprocating heddle frame assembly on a loom which holds the warp ends and raises and lowers the warp ends during shedding. Since the structural and operational features of a loom are well known, only so much of a loom and heddle frame assembly is illustrated as is necessary for an understanding of the present invention.

Referring now to the drawings, a heddle frame is designated generally as 10 which includes a side frame 12 and a side frame 14. A pair of frame slats A extend between the side frames 12 and 14. There is a top frame slat 16 and a bottom frame slat 18. Frame slat 18 carries an integral heddle rod 20 and frame slat 16 carries an integral heddle rod 22. A plurality of heddles 24 are carried in the frame assembly between the heddle rods 20 and 22. The heddles include hook ends 26 and 28 which are received over the heddle rods 20 and 22, respectively. A heddle eye at 30 receives a warp end (not shown) threaded therethrough by means of which the warp end is raised and lowered during shedding.

Figure 2:
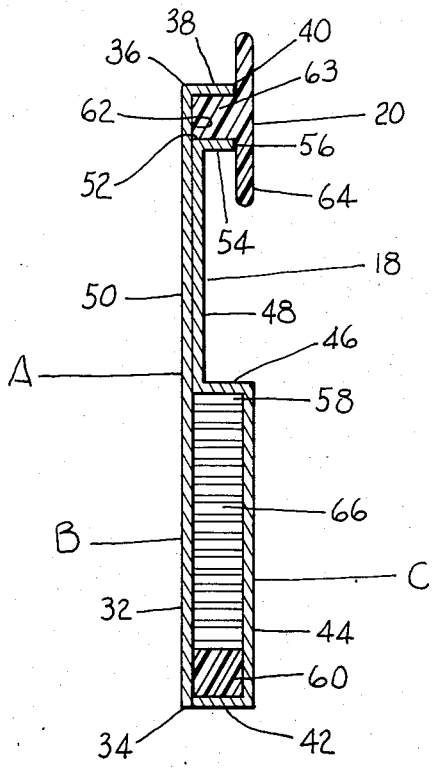
FIG. 2 is a sectional view taken along line 2—2 of FIG. 1.
Figure 3:
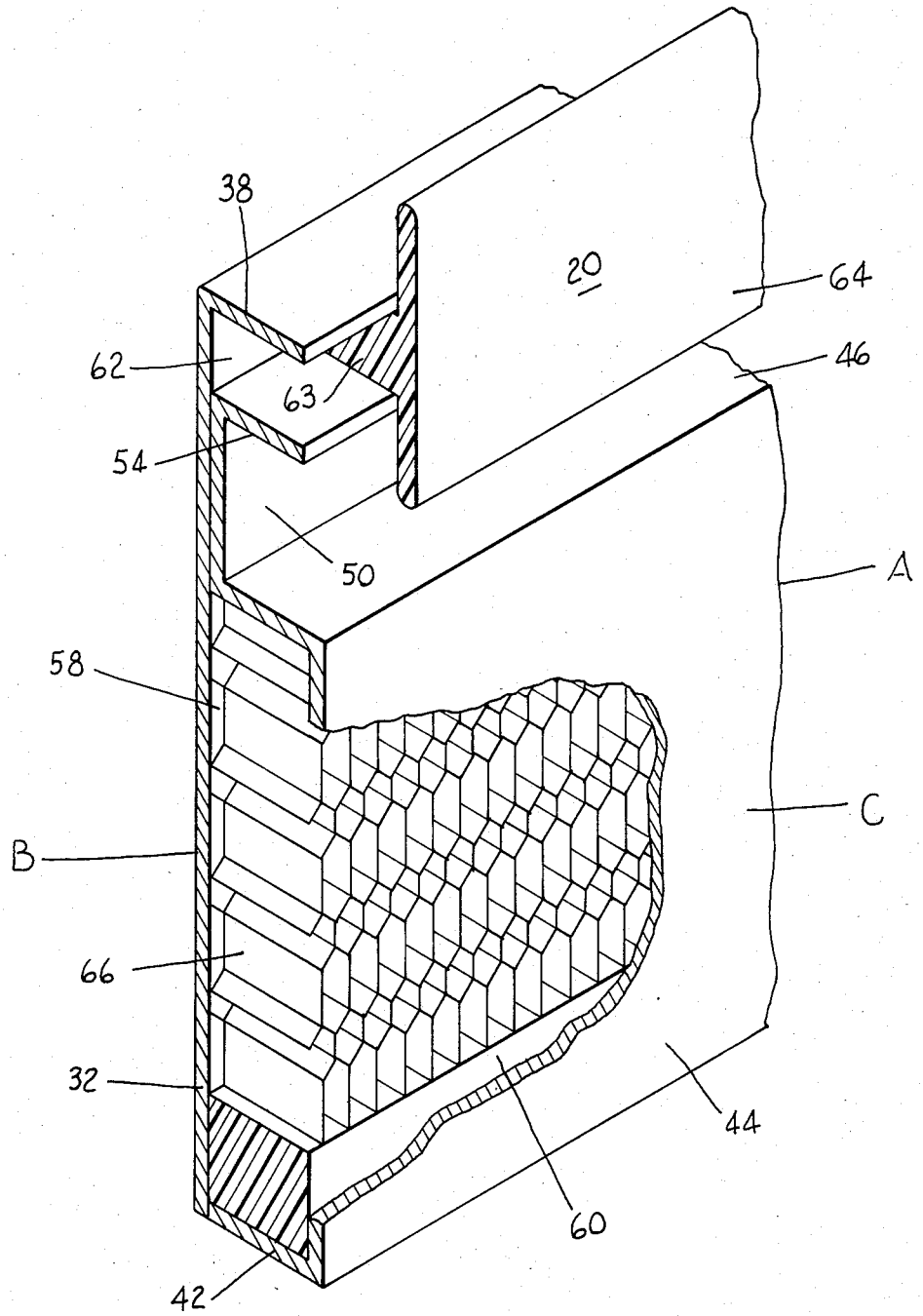
FIG. 3 is a perspective view with parts cut away illustrating a fabricated frame slat constructed according to the instant invention having increased shear resistance at the connection of the heddle rod and the frame slat.

In accordance with the present invention, the frame slats A are advantageously constructed as is best illustrated in FIGS. 2 and 3. FIG. 2 is a sectional view of the bottom frame slat 18. It is to be understood that the top frame slat 16 would be identical to the bottom frame slat 18 even though the top frame slat would be inverted to the frame slat shown in FIG. 2 in operation. Therefore, reference to frame slat 18 as including upper and lower edges is for purposes of description only, and not limitative, as the surfaces would be reversed in describing the frame slat 16.

Accordingly, the frame slat 18 is illustrated as a thin, roll-formed frame which includes a thin wall, roll-formed back plate B and front plate C. Back plate B includes a vertical side 32 which extends from a lower edge 34 to an upper edge 36. At the upper edge, the back plate B is formed to have a terminal side in the form of a first ledge 38 which terminates in a free end 40. The terminal end 38 is roll-formed. The thin wall, roll-formed steel front plate C is parallel to the back plate B and extends generally the entire length of the heddle frame assembly. The front wall plate C is roll-formed and includes a lower edge in the form of a first horizontal wall 42. The horizontal wall 42 terminates at a first vertical side 44 which extends to a second horizontal wall 46. The horizontal wall 46 terminates at a second vertical side 48 which lies flush against the vertical side 32 of the back plate to form a reduced neck portion at 50. The front plate C terminates at a upper edge 52 in the form of a terminals side which defines a second ledge 54 terminating in a free end 56. The entire front plate C is roll-formed to have the configuration just described.

As best can be seen in FIG. 2, the back plate B and the front plate C define a box shaped core space 58 adjacent the lower most edge of the frame slat. The box shaped hollow space is defined by the vertical side 32 of the back plate B, and the first horizontal side 42, the vertical side 44, and the second horizontal side 46 of the front plate C. An integral stiffening means 60 is disposed in the core space at the lowermost edge of the frame slat for providing bending resistance and reinforcement. As illustrated, the integral stiffening means is preferably a carbon fiber pultrusion. It is also mentioned that the first horizontal side 42 of the front plate C may be omitted so that the pultrusion 60 forms the lower most edge of the frame slat.

Referring again to FIGS. 2 and 3, the first ledge 38 and the second ledge 54 are illustrated as defining an elongated shear-resisting mounting slot 62 for the heddle rod 20 which extends generally along the entire length of the heddle frame. The slot provides a mounting socket in which the heddle rod may be mounted to the frame slat with reduced shear forces. The heddle rod 20 is illustrated in the form of a T-shaped heddle rod having a rod stem 63 and a transverse heddle supporting flange 64 about which the hook end 26 of the heddle is attached. The rod stem 63 is received in the mounting socket 62 and affixed therein by any suitable means such as adhesive bonding. The heddle rod 20 is preferably a carbon fiber pultrusion, in which case an epoxy glue may be utilized. A capped heddle rod as shown in application Ser. No. 393,635 filed on June 30, 1982 entitled EXTRUDED HEDDLE ROD AND CAP, commonly assigned to the assignee herein, may be advantageously utilized with the present invention. A lightweight reinforcing material such as a nylon honeycomb structure 66 may be utilized within the core space 58 to add stiffness and to reinforce the frame slat against bending and twisting forces. The front and back plates may be bonded together at their contact surfaces by any suitable means. The pultrusions may be bonded to the roll-formed steel by any suitable adhesive such as epoxy adhesive.

One of the advantages of the invention is that the overall thickness of the frame slat is reduced with the thin wall construction of the roll-formed steel which may be on the order of 0.01 inches. The layout construction disclosed in the aforedescribed U.S. Pat. No. 4,484,604 and the prior art extruded constructions are limited by their processes of formation to a much thicker overall construction. The instant invention gives the advantage of overall reduced thickness without sacrificing structural integrity. It has been found that a 40% weight reduction can be had with a frame slat constructed in accordance with the instant invention over the prior extruded and lay-up constructions. The shearing forces encountered with the prior art frame slats at the connection of the heddle rod and frame slat are overcome according to the mounting socket attachment of the instant invention.

While a preferred embodiment of the invention has been described using specific terms, such description is for illustrative purposes only, and it is to be understood that changes and variations may be made without departing from the spirit and scope of the following claims.

What is claimed is:

1. In a heddle frame assembly for a loom of the type which includes upper and lower frame slats vertically spaced side by side frame members, heddle rods carried by the frame slats between which heddles are supported in the frame, wherein said heddle frame slat comprises:

an elongated, thin, rolled-formed steel back plate extending generally the entire length of said heddle frame assembly having an upper edge and a lower edge;

an elongated, thin, roll-formed steel front plate extending generally the length of said heddle frame assembly parallel to said back plate having an upper edge and a lower edge;

a first ledge formed adjacent to said upper edge of said back plate extending perpendicular to said back plate;

a second ledge formed adjacent said upper edge of said front plate extending perpendicular to said front plate;

a longitudinal sheer-resistant mounting socket formed between said first and second ledges generally across the entire length of said frame slat;

a generally box shaped core space formed between said back plate and front plate;

a lightweight reinforcing material carried within said core space providing stiffness to said frame slat and resistance against bending;

a reduced neck portion, connecting said box shaped core space and said mounting socket, wherein said back plate and said front plate extend in parallel planes and in abutting contact with each other;

a T-shaped heddle rod having a rod stem and a heddle retaining rod flange extending transverse to said rod stem; and said rod stem being received and fixed within said longitudinal mounting slot whereby shearing forces in opposing vertical directions occurring during shedding motion are effectively resisted.

2. The frame slat of claim 1 including integral stiffening means interposed between said front plate and said back plate in said box shaped core space along said lower edge of said front and back plates joining same together as an integral beam structure stiffening said frame slat against bending.

3. The frame slat of claim 1 wherein said first ledge means includes a terminal side of said back plate bent outwardly adjacent said upper edge thereof perpendicular to said back plate, and said second ledge includes a terminal side of said front plate bent outwardly at said upper edge thereof perpendicular to said front plate.

4. The device of claim 1 wherein said back plate includes a thin, roll-formed steel plate formed to include a flat vertical side extending from the lower edge to said upper edge, and a perpendicular terminal side extending from said upper edge to a free edge defining said first ledge.

5. The frame slat of claim 1 wherein said front plate includes a thin roll-formed steel plate which includes a first horizontal surface beginning at said lower edge thereof and terminating at a first vertical side, said vertical side extending downwardly and terminating at a second horizontal side, said second horizontal side extending inwardly terminating at a second vertical side extending from said second horizontal side to said lower edge of said front plate, and a terminal side of said front plate extending from said second vertical side outwardly to a free edge to define said second ledge.

6. The frame slat of claim 5 including a longitudinal stiffening means interposed between said vertical side of said back plate and said first vertical side of said front plate at said lower edges thereof.

7. The device of claim 2 wherein said front plate includes a horizontal side which extends over said integral stiffening means and forms an outer enclosure for said box shaped core space.

8. The device of claim 1 wherein said lightweight reinforcing material includes a honeycomb structure.

9. The frame slat of claim 1 wherein said integral stiffening means includes a elongated strip of fiberreinforced thermoplastic material.

10. The device of claim 1 wherein said frame slat includes a reduced neck portion intermediate said box shaped core space and said first and second ledges, said front and back plates being flush with one another at said reduced neck portion.

11. In a heddle frame assembly for a loom of the type which includes upper and lower frame slats vertically spaced by side frame members, heddle rods carried by said frame slats between which heddles are supported in the frame, said heddle frame being reciprocated up and down in a shedding motion during weaving, wherein said heddle frame slat comprises:

a thin wall, roll-formed steel frame extending generally the entire length of said heddle frame assembly;

a hollow box shaped core space formed within said thin wall steel frame;

a reduced neck portion formed by opposing sides of said thin wall steel frame forming said box shaped core space being brought together in flesh relationship intermediate said core space and said ledge means;

ledge means formed in said thin wall steel frame at one end thereof extending in a transverse direction to said frame slat;

and a transverse shear-resisting mounting slot defined by said ledge means extending generally across the entire length of said heddle frame assembly;

a generally T-shaped heddle rod having a rod stem and a transverse mounting frange; and said rod stem being carried within said longitudinal mounting slot whereby shear forces acting between said heddle rod stem and frame slot during shedding are effectively reduced by mounting said rod stem in said longitudinal mounting slot.

12. The frame slat of claim 11 wherein said heddle rod consists of a carbon fiber pultrusion.

13. The frame slat of claim 11 including an elongated integral stiffening means exposed within said box shaped core space extending generally along the entire length of said heddle frame assembly reinforcing said frame slat against bending.

14. The frame slat of claim 13 wherein said thin wall steel frame completely encloses said integral stiffening means within said core space.

15. In a heddle frame assembly for a loom of the type which includes upper and lower frame slats vertically spaced by side frame members, heddle rods carried by said frame slats between which heddles are supported in the frame, wherein said heddle frame slats comprises:

a thin wall back plate extending generally the entire length of said heddle frame assembly;

a thin wall front plate parallel with said back plate extending generally the entire length of said heddle frame assembly;

said back plate and front plate being spaced apart and being parallel with one another to define a box shaped core space therebetween;

a reduced neck portion adjacent said core space defined by said thin wall front plate and back plate being engaged in a flush relationship;

an elongated longitudinal heddle rod mounting slot formed generally across the entire length of said frame slat adjacent to said reduced neck portion defined by said back plate being bent outwardly in a first terminal end perpendicular to said back plate and said front plate being bent outwardly in a second terminal end extending perpendicular to said front plate, said first and second terminal ends being spaced apart to define said longitudinal mounting slot; and a generally T-shaped heddle rod having a rod stem and a transverse flange on which said heddles are carried, said rod stem being affixed within said longitudinal heddle rod mounting slot whereby shearing forces between said heddle rod and said frame slat are greatly reduced.

16. The frame slat of claim 15 wherein said thin wall back plate and said thin wall front plate are formed from a roll-formed thin steel plate.

17. The frame slat of claim 15 including a lighweight reinforcing material disposed in said box shaped core space.

18. The frame slat of claim 15 including an integral stiffening means disposed between said thin wall back plate and said thin wall front plate at an edge of said frame slat remote from said heddle rod reinforcing said frame slat against bending.

19. The frame slat of claim 18 wherein said thin wall front plate includes a horizontal side extending over said integral stiffening means to enclose the same within said boxed space.

* * * * *